US009205692B2

(12) United States Patent
Suzuki

(10) Patent No.: US 9,205,692 B2
(45) Date of Patent: Dec. 8, 2015

(54) INK RIBBON CASSETTE AND PRINTING DEVICE

(71) Applicant: CANON KABUSHIKI KAISHA, Tokyo (JP)

(72) Inventor: Masaki Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/543,701

(22) Filed: Nov. 17, 2014

(65) Prior Publication Data

US 2015/0145940 A1 May 28, 2015

(30) Foreign Application Priority Data

Nov. 22, 2013 (JP) ..... 2013-242003

(51) Int. Cl.
*B41J 17/32* (2006.01)
*B41J 32/00* (2006.01)
*B41J 33/16* (2006.01)

(52) U.S. Cl.
CPC *B41J 33/16* (2013.01); *B41J 17/32* (2013.01); *B41J 32/00* (2013.01)

(58) Field of Classification Search
USPC ..... 347/214, 216; 400/207, 208, 208.1
See application file for complete search history.

(56) References Cited

U.S. PATENT DOCUMENTS

| | | | | |
|---|---|---|---|---|
| 6,504,564 | B1 * | 1/2003 | Funaki et al. | 347/214 |
| RE40,202 | E * | 4/2008 | Funaki et al. | 347/214 |
| 7,736,076 | B2 * | 6/2010 | Motoki | 400/208 |
| 2005/0084310 | A1 * | 4/2005 | Funaki et al. | 400/208 |

FOREIGN PATENT DOCUMENTS

| | | | | |
|---|---|---|---|---|
| JP | 2001-205879 | * | 7/2001 | B41J 32/00 |
| JP | 2005-119126 | A | 5/2005 | |

* cited by examiner

*Primary Examiner* — Huan Tran
(74) *Attorney, Agent, or Firm* — Canon U.S.A., Inc. IP Division

(57) ABSTRACT

An ink ribbon cassette includes a supply bobbin around which an ink ribbon is wound, a take-up bobbin around which the ink ribbon fed from the supply bobbin is wound, and a case in which the supply bobbin and the take-up bobbin are rotatably held. The case includes a contact portion that bends a path along which the ink ribbon is transported by coming into contact with the ink ribbon. The contact portion that has come into contact with the ink ribbon is movable as a result of receiving a tension in the ink ribbon.

12 Claims, 7 Drawing Sheets

INK RIBBON CASSETTE AND PRINTING DEVICE

BACKGROUND OF THE INVENTION

1. Field of the Invention

The present invention relates to an ink ribbon cassette in which an ink ribbon is held or to a printing device.

2. Description of the Related Art

Dye sublimation printers perform printing by transferring dye applied to an ink ribbon to a sheet, which is an example of a recording medium, by pressing the recording medium and the ink ribbon against each other using a thermal head and a platen roller, passing an electric current through the thermal head so that a heat generator on the thermal head generates heat, and then sublimating the dye with the heat.

The ink ribbon is held in an ink ribbon cassette for facilitating attachment or removal of the ink ribbon to or from a printer body. The ink ribbon cassette is configured to be attachable to and detachable from the printer body. In the ink ribbon cassette, cylindrical supply bobbin and take-up bobbin, around which an ink ribbon is wound, are held. The supply bobbin and the take-up bobbin are rotatably held in the ink ribbon cassette.

The ink ribbon cassette is mounted on the printer body in such a manner that the thermal head is located between the supply bobbin and the take-up bobbin. Printing is performed by pressing the thermal head and the platen roller against each other in a state where the ink ribbon and a sheet overlap each other.

For high definition printing, the ink ribbon has to be stably transported inside the ink ribbon cassette. In Japanese Patent Laid-Open No. 2005-119126, an ink ribbon pulled out from a supply bobbin is guided by a guide shaft that has a laterally long stick shape and then wound around the take-up bobbin after the direction in which the ink ribbon is pulled out is changed by approximately 90°, whereby the ink ribbon is stably transported.

SUMMARY OF THE INVENTION

The present invention realizes provision of an ink ribbon cassette that does not include a metal or high-rigidity guide shaft.

An aspect of the present invention provides an ink ribbon cassette that includes a supply bobbin around which an ink ribbon is wound; a take-up bobbin around which the ink ribbon fed from the supply bobbin is wound; and a case in which the supply bobbin and the take-up bobbin are rotatably held. The case includes a contact portion that bends a path along which the ink ribbon is transported by coming into contact with the ink ribbon. The contact portion that has come into contact with the ink ribbon is movable as a result of receiving a tension in the ink ribbon.

According to another aspect of the present invention, an ink ribbon cassette that does not include a metal or high-rigidity guide shaft is capable of being provided.

Further features of the present invention will become apparent from the following description of exemplary embodiments with reference to the attached drawings.

DESCRIPTION OF THE EMBODIMENTS

First Embodiment

Referring to FIG. 1 to FIG. 6B, a first embodiment of the present invention is described below.

Figure 1:
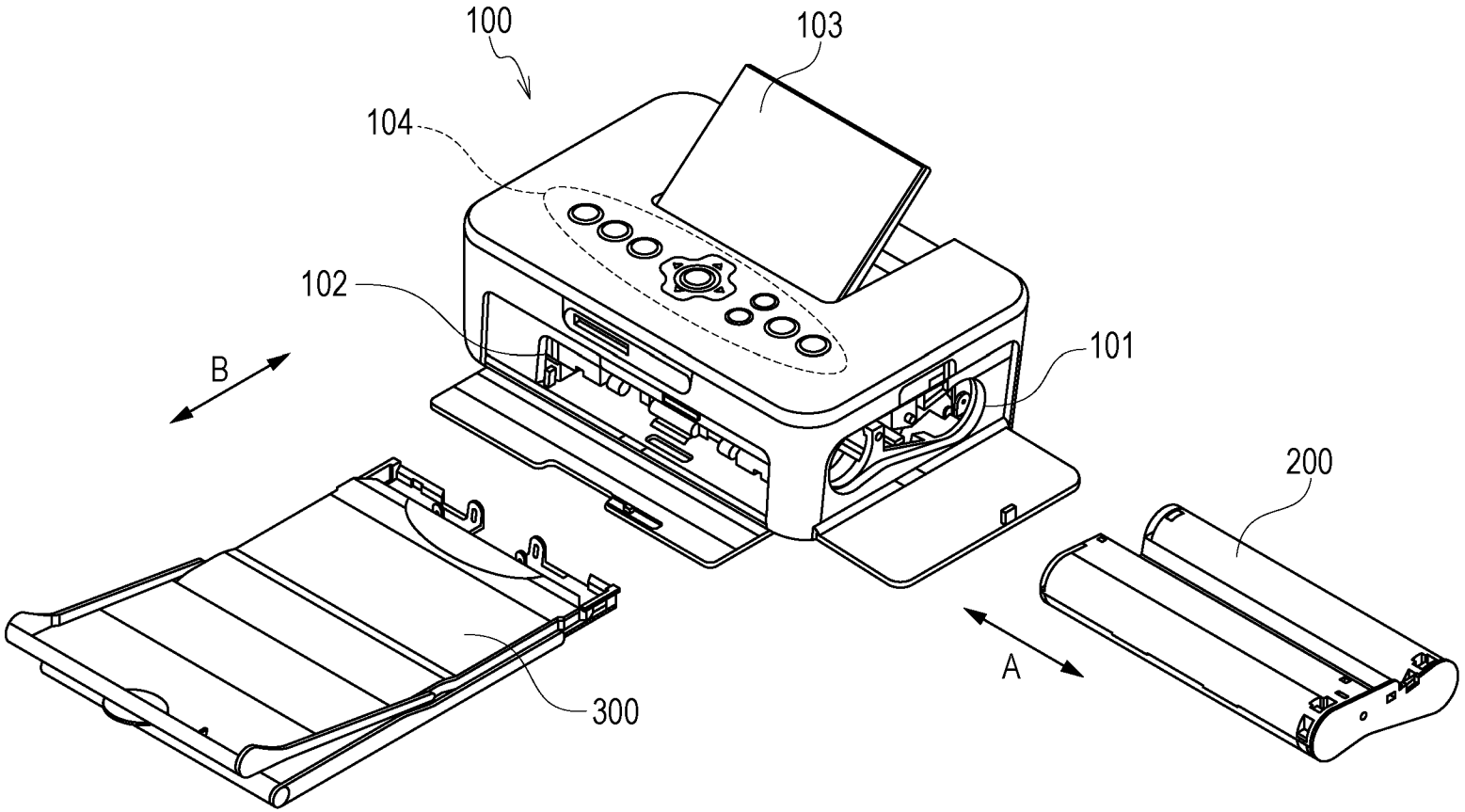
FIG. 1 is a perspective view of a printer body and the entirety of an ink ribbon cassette.

FIG. 1 is a perspective view of a printer body and the entirety of an ink ribbon cassette according to the embodiment of the present invention.

Here, 100 represents a printer body, 200 represents an ink ribbon cassette, and 300 represents a sheet tray. The printer body 100 has an ink-ribbon-cassette insertion opening 101 on a side surface to allow the ink ribbon cassette 200 to be mounted on the printer body 100. The ink ribbon cassette 200 is attachable to and removable from the printer body 100 in the direction of arrow A. The direction of arrow A here is a direction substantially parallel to the longitudinal direction of a thermal head disposed in the printer body 100. The printer body 100 has a sheet-tray insertion opening 102 on the front surface to allow the sheet tray 300 to be mounted on the printer body 100. The sheet tray 300 is attachable to and removable from the printer body 100 in the direction of arrow B (the direction substantially perpendicular to the direction of arrow A).

Here, 103 represents a display unit and 104 represents an operation portion, which is disposed on the top surface of the printer body 100. The display unit 103 includes a liquid crystal display (LCD). The display unit 103 displays an image that is to be printed, image processing information, or the like. The operation portion 104 is operated to select an image, to instruct image processing, or to instruct printing.

Figure 2:
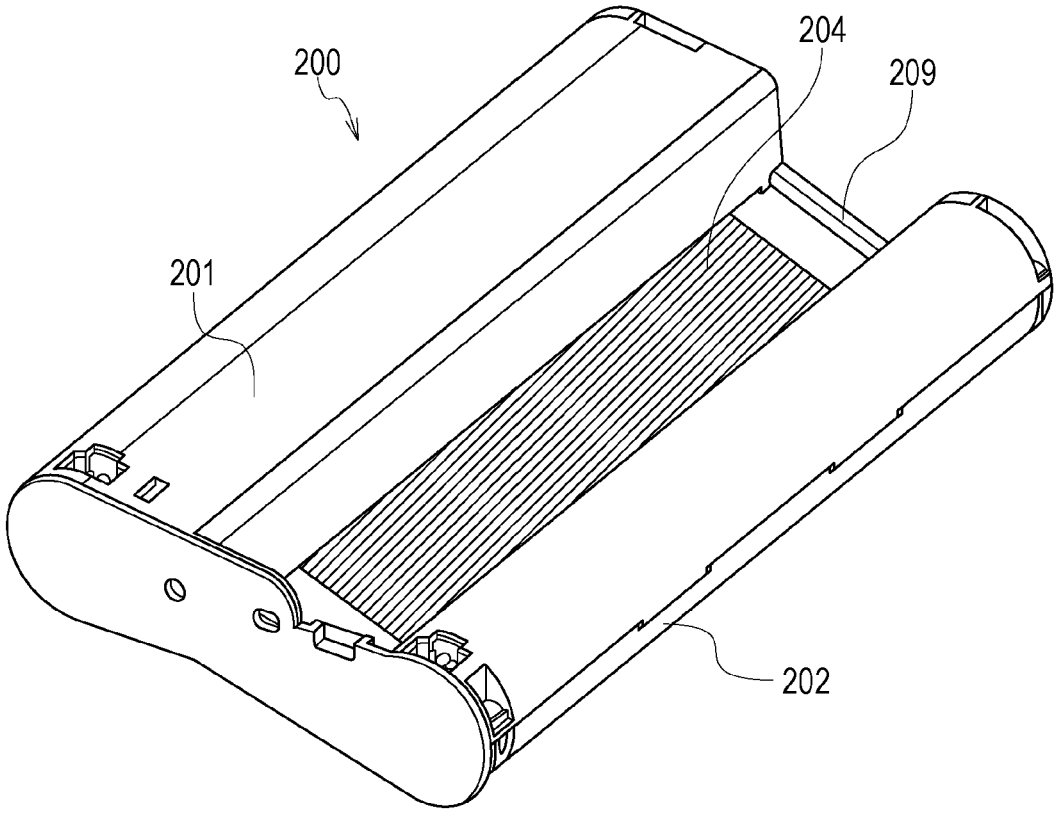
FIG. 2 is a perspective view of the ink ribbon cassette.
Figure 3:
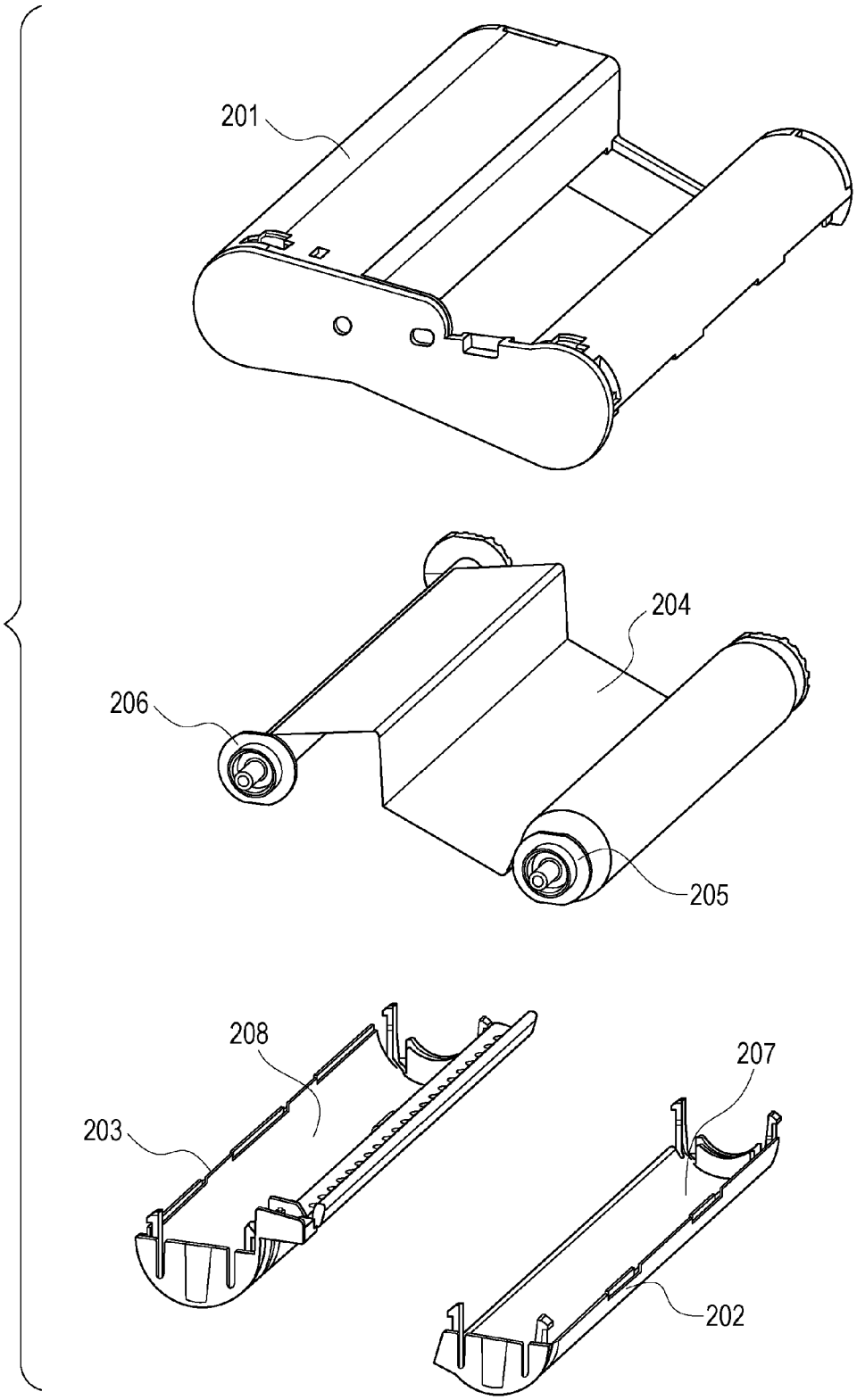
FIG. 3 is an exploded perspective view of the ink ribbon cassette.

FIG. 2 is a perspective view of the ink ribbon cassette 200 and FIG. 3 is an exploded perspective view of the ink ribbon cassette 200.

As illustrated in FIGS. 2 and 3, the ink ribbon cassette 200 includes an upper case 201, a first lower case 202, and a second lower case 203. The case 201, the first lower case 202, and the second lower case 203 become engaged together using claws and holes, which are not illustrated.

As illustrated in FIG. 3, the ink ribbon cassette 200 includes a supply bobbin holding portion 207, in which the supply bobbin 205 from which the ink ribbon 204 is fed is held, and a take-up bobbin holding portion 208, in which the take-up bobbin 206 around which the fed ink ribbon 204 is wound is held. The upper case 201 and the first lower case 202 define the supply bobbin holding portion 207 whereas the upper case 201 and the second lower case 203 define the take-up bobbin holding portion 208.

Figure 4:
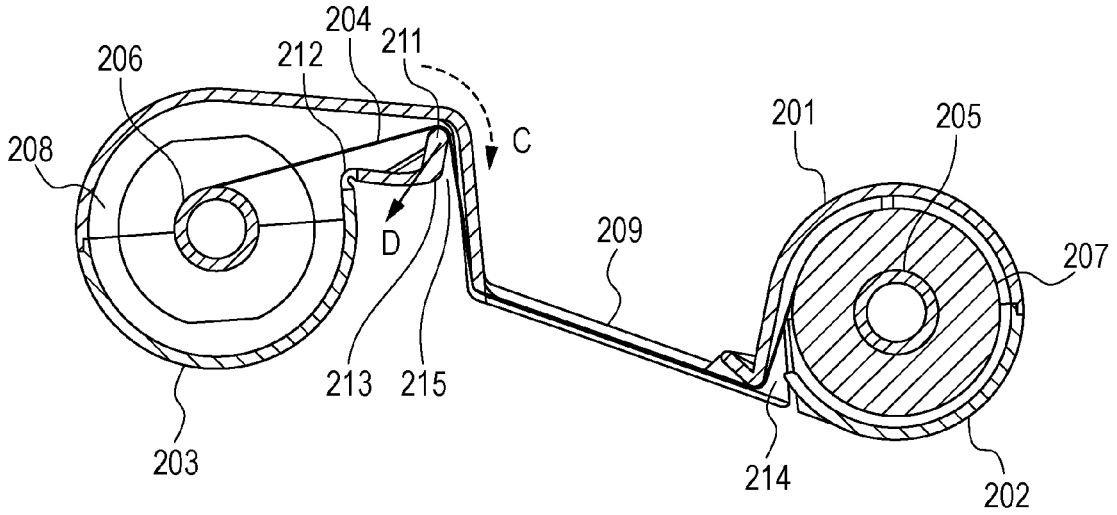
FIG. 4 is a cross-sectional view of the ink ribbon cassette.
Figure 5A:
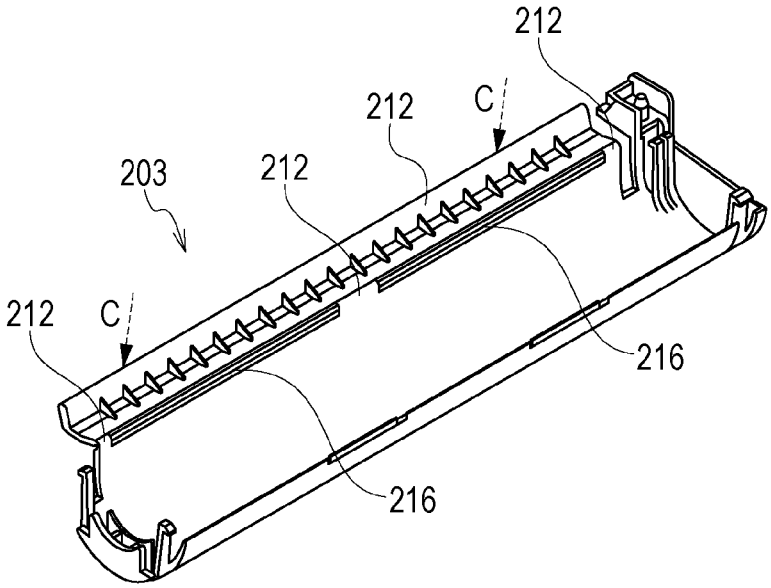
FIGS. 5A to 5C include perspective views and a cross-sectional view of a second lower case.
Figure 5B:
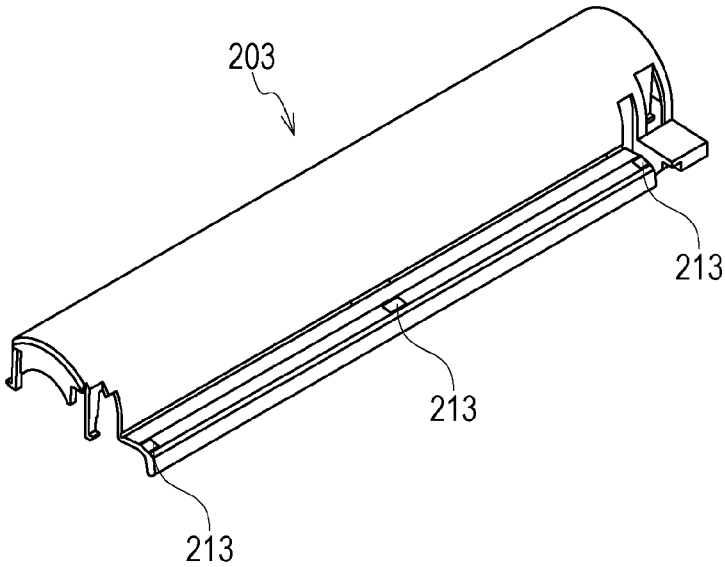
Figure 5C:
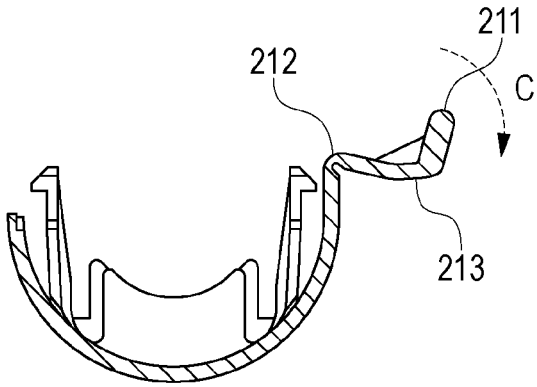

FIG. 4 is a cross-sectional view of the ink ribbon cassette 200, FIGS. 5A and 5B are perspective views of the second lower case 203, and FIG. 5C is a cross-sectional view of the second lower case 203.

As illustrated in FIG. 4, the supply bobbin holding portion 207 and the take-up bobbin holding portion 208 are connected together by a connection portion 209 and spaced apart from each other with a predetermined distance.

The supply bobbin 205 held in the supply bobbin holding portion 207 is rotatably held and the ink ribbon 204 is pulled out through a supply opening 214. The ink ribbon 204 pulled out from the supply bobbin holding portion 207 is transported through a take-up opening 215 toward the take-up bobbin holding portion 208 in which the ink ribbon 204 is wound. When the ink ribbon 204 is transported toward the take-up bobbin holding portion 208, the ink ribbon 204 comes into contact with a ribbon contact surface 211 formed on the second lower case 203, at which the direction in which the ink ribbon 204 is transported is changed by approximately 90°, and then the ink ribbon 204 is wound around the take-up bobbin 206. The take-up bobbin 206 that is rotatably held is engaged with a bobbin rotation driving unit, not illustrated, disposed in the printer body 100, so as to drive rotatably.

As illustrated in FIGS. 5A and 5B, a contact portion is formed at the take-up opening 215 of the second lower case 203. The contact portion includes an ink ribbon contact surface 211, with which the ink ribbon 204 comes into contact, displacement restricting portions 213, which come into contact with a restricting surface formed on the printer body 100, elastically deformable portions 212, and openings 216. Since the contact portion includes the elastically deformable portions 212, the contact portion is movable in the direction of arrow C by elastic deformation of the elastically deformable portions 212. The ink ribbon contact surface 211 extends in the width direction of the ink ribbon 204 and is sized slightly larger than the width of the ink ribbon 204. Thus, the ink ribbon contact surface 211 is capable of coming into contact with the ink ribbon 204 throughout the entire width of the ink ribbon 204. The ink ribbon contact surface 211 has such a shape that a middle portion in the width direction of the ink ribbon 204 is convex. Thus, a force that extends the ink ribbon 204 toward both ends occurs while the ink ribbon 204 is guided by the ink ribbon contact surface 211 and the force is capable of preventing the ink ribbon 204 from being creased, twisted, or subjected to other troubles.

As illustrated in FIG. 5C, the elastically deformable portions 212 each have locally thin portions. The elastically deformable portions 212 are disposed at multiple positions in the width direction of the ink ribbon 204 so as to have such spring characteristics as to be deformable in the direction of arrow C in FIG. 5C. As illustrated in FIG. 5A, in this embodiment, the elastically deformable portions 212 are disposed at three portions, both end portions and a middle portion in the width direction of the ink ribbon 204 (direction perpendicular to the direction in which the ink ribbon is transported). The elastically deformable portion 212 at the middle portion has a larger width than the elastically deformable portions 212 at both end portions. Thus, when a force in the direction of arrow C of FIG. 5A is exerted on the ink ribbon contact surface 211, the elastically deformable portions 212 at both end portions are firstly deformed in the direction of arrow C and then the elastically deformable portion 212 at the middle portion is deformed in the direction of arrow C. The configuration in which the openings 216 are formed between the three elastically deformable portions 212 in the width direction of the ink ribbon 204 facilitates deformation of the elastically deformable portion 212.

During a printing operation, the ink ribbon 204 is transported while being pressed by the thermal head 120 and the platen roller 130 and thus a high tension occurs in a portion of the ink ribbon 204 that is closer to the take-up bobbin 206. The tension in the ink ribbon 204 causes a force in the direction of arrow D of FIG. 4 and the force is applied to the ink ribbon contact surface 211, so that the ink ribbon contact surface 211 is pressed downward in the direction of arrow C. When the ink ribbon contact surface 211 is pressed downward in the direction of arrow C of FIG. 4, both ends of the ink ribbon contact surface 211 are firstly displaced in the direction of arrow C and then the middle portion of the ink ribbon contact surface 211 is displaced in the direction of arrow C. Specifically, when the ink ribbon contact surface 211 is pressed downward in the direction of arrow C of FIG. 4 due to the tension in the ink ribbon 204, the ink ribbon contact surface 211 is deformed in the direction of arrow C while keeping such a shape that the middle portion is convex. Thus, since the force that extends the ink ribbon 204 toward both ends occurs, the force is capable of preventing the ink ribbon 204 from being creased, twisted, or subjected to other troubles.

In this embodiment, the elastic deformability is controlled by varying the widths of the elastically deformable portions 212 at both end portions and the middle portion (the widths of the openings 216). However, the elastic deformability may be controlled by varying the thicknesses of the elastically deformable portions 212. Specifically, the elastic deformability is capable of being controlled by making the thickness of the elastically deformable portion 212 at the middle portion larger than the thickness of the elastically deformable portions 212 at both end portions.

As illustrated in FIG. 5B, in the embodiment, the displacement restricting portions 213 are disposed at three portions, at both end portions and the middle portion in the width direction. In the case where the ink ribbon contact surface 211 is pressed downward in the direction of arrow C of FIG. 4 by the tension in the ink ribbon 204 and the ink ribbon contact surface 211 is displaced to a predetermined position, the displacement restricting portions 213 at both end portions and the middle portion come into contact with a restricting surface formed on the printer body 100, which will be described below. Consequently, the ink ribbon contact surface 211 is capable of being prevented from being deformed throughout the entire width of the ink ribbon contact surface 211 and is thus kept in a predetermined position during the printing operation. The ink ribbon contact surface 211 is thus prevented from being excessively deformed and the ink ribbon 204 is capable of being prevented from being creased, twisted, or subjected to other troubles.

Although the displacement restricting portions 212 are disposed at both end portions and the middle portion in this embodiment, at least one displacement restricting portion 212 will suffice. The displacement restricting portion 212 may be in contact with the restricting surface formed on the printer body throughout the entire width of the restricting surface.

Now, the operation performed when the ink ribbon cassette 200 is mounted on the printer body 100 is described.

Figure 6A:
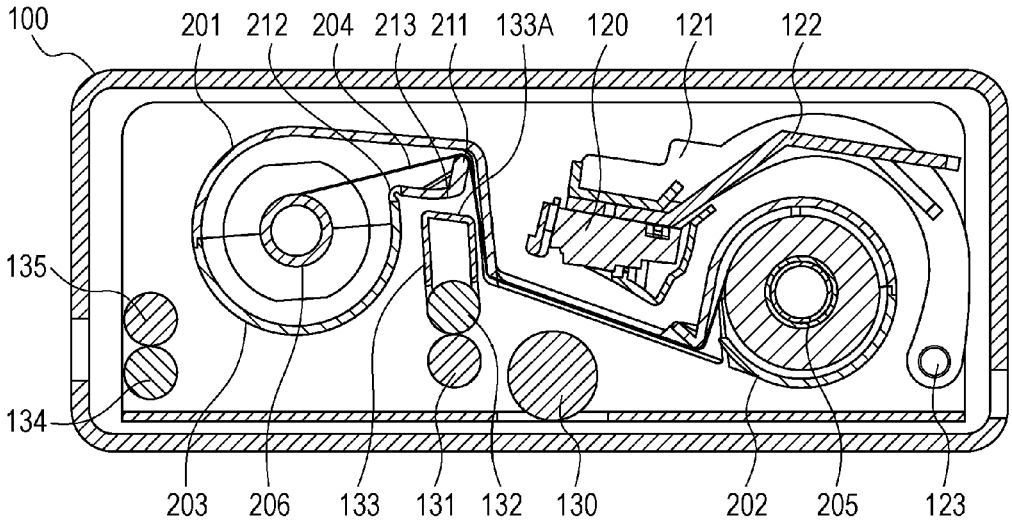
FIGS. 6A to 6B are cross-sectional views in the state where the ink ribbon cassette is mounted on the printer body.
Figure 6B:
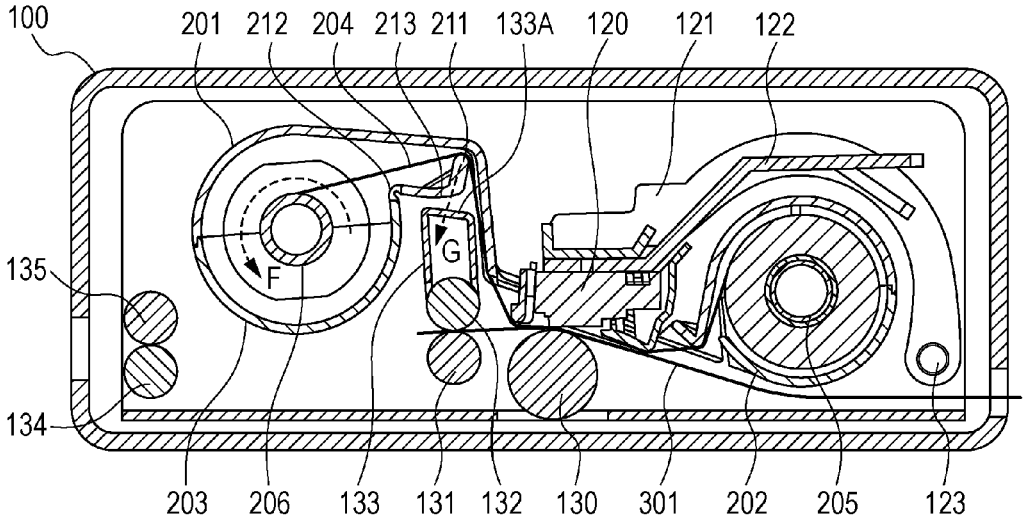
Figure 7:
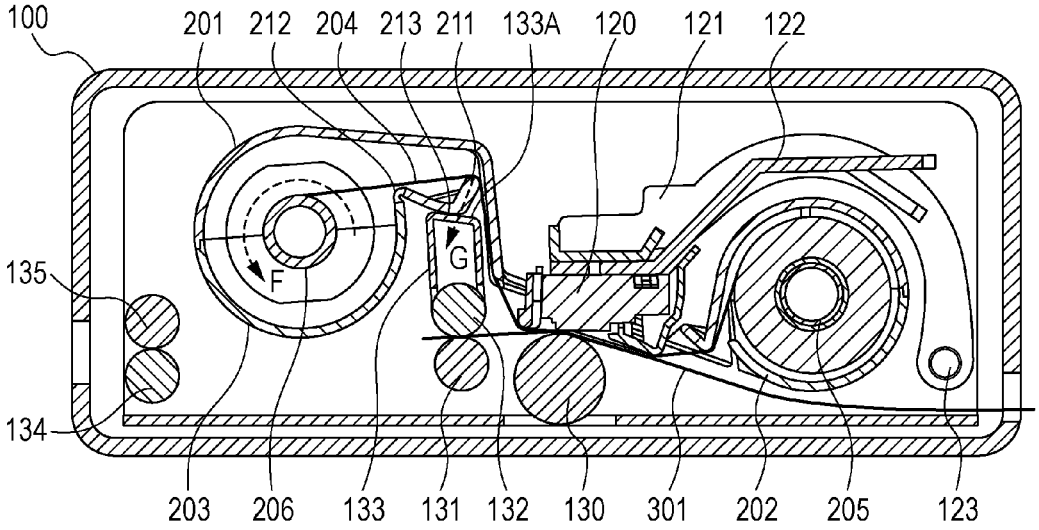
FIG. 7 is a cross-sectional view in the state where the ink ribbon cassette is mounted on the printer body.

FIGS. 6A, 6B, and 7 are cross-sectional views of the state where the ink ribbon cassette 200 is mounted on the printer body 100. FIG. 6A is a cross-sectional view of the state where the thermal head 120 is in a stand-by position, FIG. 6B is a cross-sectional view of the state where the thermal head 120 is in a printing position, and FIG. 7 is a cross-sectional view of the state where the printer body is performing the printing operation.

As illustrated in FIG. 6A, 120 represents a thermal head, 121 represents a thermal-head support arm, 122 represents a heat sink, and 130 represents a platen roller. The thermal head 120 is held by the thermal-head support arm 121 and supported so as to be rotatable around a rotation shaft 123. The thermal head 120 is rotatable from the stand-by position illustrated in FIG. 6A to the printing position illustrated in FIG. 6B and is capable of causing a pressing force at a position between itself and the platen roller 130. The heat sink 122 is attached to the thermal head 120 and is configured so as to be capable of transferring heat generated at the thermal head 120 to the heat sink 122. The platen roller 130 is rotatably disposed on the printer body 100 and configured to rotate in accordance with the transportation of a sheet.

Here, 131 represents a transport roller, 132 represents a driven roller, and 133 represents a driven-roller support frame. The transport roller 131 and the driven roller 132 are rollers used to transport sheets. The transport roller 131 is driven by a sheet transport motor, not illustrated, so as to drive rotatably. The driven roller 132 is rotatably supported by the driven-roller support frame 133. The driven roller 132 is a driven roller facing the transport roller 131 and is configured to rotate following the rotation of the transport roller 131. The driven-roller support frame 133 is made of a metal material.

The driven-roller support frame 133 has a restricting surface 133A on the top surface, the restricting surface 133A coming into contact with the displacement restricting portions 213 formed on the second lower case 203 of the ink ribbon cassette 200.

Here, 134 represents a sheet-ejection driving roller and 135 represents a sheet-ejection driven roller. The sheet-ejection driving roller 134 is driven by a sheet transport motor, not illustrated, so as to drive rotatably. The sheet-ejection driven roller 135 is a driven roller facing the sheet-ejection driving roller 134 and is configured to rotate following the rotation of the sheet-ejection driving roller 134.

As illustrated in FIG. 6A, when the printer body 100 is in the stand-by state, the thermal head 120 is in the stand-by position and the displacement restricting portions 213 on the second lower case 203 are spaced apart from the restricting surface 133A of the driven-roller support frame 133. Thus, the ink ribbon cassette 200 is attachable to and removable from the printer body 100 without the ink ribbon 204 and the printer body 100 interfering with each other.

Subsequently, as illustrated in FIG. 6B, when the printer body 100 is instructed to perform printing and enters into the printing state, a sheet 301 is fed by a sheet-feed mechanism, not illustrated, to a print-start position illustrated in FIG. 6B. Then, the thermal head 120 is rotated from the stand-by position illustrated in FIG. 6A to the printing position in FIG. 6B and the rotation of the thermal head 120 causes the ink ribbon 204 to be pulled out from the supply bobbin 205 as illustrated in FIG. 6B. Then, the ink ribbon 204 and the sheet 301 are pressed against each other by the thermal head 120 and the platen roller 130.

In addition, when the printer body 100 starts the printing operation, the take-up bobbin 206 is driven to rotate in the direction of arrow F of FIG. 6B by a bobbin rotating portion, not illustrated, to wind the ink ribbon 204 around the take-up bobbin 206. Here, since the ink ribbon 204 is pressed by the thermal head 120 and the platen roller 130, a tension occurs in the ink ribbon 204 in the direction in which the ink ribbon 204 is pulled out. Since the path along which the ink ribbon 204 is transported is bent at the ink ribbon contact surface 211 so that the direction of the path is changed by approximately 90°, the ink ribbon contact surface 211 receives a force in the direction of arrow G of FIG. 6B due to the tension that has occurred in the ink ribbon 204.

When the ink ribbon contact surface 211 is pressed inward in the direction of arrow G of FIG. 6B, the elastically deformable portions 213 at both end portions are firstly deformed and then the elastically deformable portion 213 at the middle portion is deformed, as described above. Thus, the ink ribbon contact surface 211 is deformed in the direction of arrow G of FIG. 6B while keeping such a shape that the middle portion is convex and then the displacement restricting portions 213 and the restricting surface 133A on the driven-roller support frame 133 come into contact with one another, as illustrated in FIG. 7. When the displacement restricting portions 213 and the driven-roller support frame 133 are in contact with one another, the movement of the contact portion is restricted to a predetermined distance. Since the ink ribbon contact surface 211 keeps such a shape that the middle portion is convex while the ink ribbon contact surface 211 is being deformed, the ink ribbon 204 is capable of being deformed without being creased, twisted, or subjected to other troubles.

Since the restricting surface 133A is substantially perpendicular to the direction in which the ink ribbon contact surface 211 is pressed inward by the tension that has occurred in the ink ribbon 204 (the direction of arrow G), the ink ribbon contact surface 211 is fixed at the position illustrated in FIG. 7.

In other words, while the printer body 100 is in the printing operation, the restricting surface 133A formed on the printer body 100 receives the force that has occurred due to the tension in the ink ribbon 204, so that the ink ribbon contact surface 211 is capable of being kept at the position as illustrated in FIG. 7. Moreover, since the restricting surface 133A is part of a metal frame and has a high rigidity, the ink ribbon contact surface 211 is not deformed from the position illustrated in FIG. 7 even when a higher tension occurs in the ink ribbon 204. The ink ribbon 204 is thus stably held by the ink ribbon contact surface 211 and is capable of being prevented from being creased, twisted, or subjected to other troubles.

Although the preferable embodiment of the invention has been described thus far, the present invention is not limited to this embodiment and is capable of being modified and changed within the scope of the gist of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-242003, filed Nov. 22, 2013, which is hereby incorporated by reference herein in its entirety.

What is claimed is:

1. An ink ribbon cassette, comprising:

a supply bobbin around which an ink ribbon is wound;

a take-up bobbin around which the ink ribbon fed from the supply bobbin is wound; and a case in which the supply bobbin and the take-up bobbin are rotatably held, wherein the case includes a contact portion that bends a path along which the ink ribbon is transported by coming into contact with the ink ribbon and an elastically deformable portion that allows the contact portion to move, and wherein the contact portion is movable as a result of receiving a tension in the ink ribbon.

2. The ink ribbon cassette according to claim 1, wherein the case includes a supply bobbin holding portion, in which the supply bobbin is held, and a take-up bobbin holding portion, in which the take-up bobbin is held, and wherein the contact portion is disposed near the take-up bobbin holding portion.

3. The ink ribbon cassette according to claim 1, wherein the contact portion is larger in a direction of a width of the ink ribbon than the width of the ink ribbon and is capable of coming into contact with the ink ribbon throughout the entire width of the ink ribbon.

4. The ink ribbon cassette according to claim 1, comprising a plurality of the elastically deformable portions provided at a plurality of positions in a direction of a width of the ink ribbon, and at least one opening is formed between the plurality of elastically deformable portions.

5. The ink ribbon cassette according to claim 4, wherein the plurality of elastically deformable portions have different widths in accordance with the positions at which the elastically deformable portions are disposed.

6. The ink ribbon cassette according to claim 5, wherein one of the elastically deformable portions disposed at a middle portion in the direction of the width of the ink ribbon has a larger width than one of the elastically deformable portions disposed at an end portion in the direction of the width of the ink ribbon.

7. The ink ribbon cassette according to claim 4, wherein the plurality of elastically deformable portions have different thicknesses in accordance with the positions at which the elastically deformable portions are disposed.

8. The ink ribbon cassette according to claim 7, wherein one of the elastically deformable portions disposed at a middle portion in the direction of the width of the ink ribbon has a larger thickness than one of the elastically deformable portions disposed at an end portion in the direction of the width of the ink ribbon.

9. An ink ribbon cassette, comprising:

a supply bobbin around which an ink ribbon is wound;

a take-up bobbin around which the ink ribbon fed from the supply bobbin is wound;

a case in which the supply bobbin and the take-up bobbin are rotatably held, wherein the case includes a contact portion that bends a path along which the ink ribbon is transported by coming into contact with the ink ribbon, and wherein the contact portion is movable as a result of receiving a tension in the ink ribbon; and a restricting portion that restricts movement of the contact portion to a predetermined distance by coming into contact with a predetermined component of a printing device when the contact portion moves in a state where the ink ribbon cassette is mounted on the printing device.

10. A printing device on which the ink ribbon cassette according to claim 9 is mountable, the printing device comprising:

a metal frame that restricts movement of the contact portion to a predetermined distance by coming into contact with the restricting portion and that holds the contact portion at a fixed position.

11. The printing device according to claim 10, wherein the metal frame is a frame that supports a roller that transports a sheet.

12. An ink ribbon cassette, comprising:

a supply bobbin around which an ink ribbon is wound;

a take-up bobbin around which the ink ribbon fed from the supply bobbin is wound; and a case in which the supply bobbin and the take-up bobbin are rotatably held, wherein the contact portion is movable as a result of receiving a tension in the ink ribbon, wherein the contact portion is movable as a result of receiving a tension in the ink ribbon, and wherein the contact portion is larger in a direction of a width of the ink ribbon than the width of the ink ribbon and is capable of coming into contact with the ink ribbon throughout the entire width of the ink ribbon.

* * * * *